US005666683A

United States Patent [19]

Gairdner

[11] Patent Number: 5,666,683

[45] Date of Patent: Sep. 16, 1997

[54] DECK CLEANING TOOL

[76] Inventor: James R. Gairdner, 77 Clarendon Avenue, Suite 501, Toronto, Ontario, Canada, M4V 1J2

[21] Appl. No.: 668,670

[22] Filed: Jun. 25, 1996

[51] Int. Cl.[6] ..... A47L 13/00

[52] U.S. Cl. ..... 15/104.001; 15/246

[58] Field of Search ..... 15/104.001, 143.1, 15/236.01, 236.05, 236.06, 236.07, 236.08, 236.09, 246

[56] References Cited

U.S. PATENT DOCUMENTS

| | | | |
|---|---|---|---|
| 57,542 | 8/1866 | Michaels . | |
| 1,004,297 | 9/1911 | Nygren et al. . | |
| 1,311,618 | 7/1919 | Penn . | |
| 2,382,852 | 8/1945 | Blackmon | 15/104.001 |
| 2,488,312 | 11/1949 | Millican et al. . | |
| 2,542,665 | 2/1951 | Gustafson . | |
| 2,597,400 | 5/1952 | Stogsdill et al. . | |
| 5,133,101 | 7/1992 | Hauser | 15/143.1 |
| 5,471,696 | 12/1995 | Linfoot | 15/104.001 |

FOREIGN PATENT DOCUMENTS

| | | |
|---|---|---|
| 2 691 349 | 11/1993 | France . |
| 89150 | 4/1957 | Norway . |

*Primary Examiner*—David Scherbel
*Assistant Examiner*—Randall E. Chin
*Attorney, Agent, or Firm*—Bereskin & Parr

[57] ABSTRACT

A tool for clearing debris wedged between floorboards of a structure, such as a deck, has an elongated shaft, a tine and a gauge member. The tine is inserted into the space between floorboards to remove the debris. A gauge member attached to the tine prevents the tine from abrading the bottom of the crevice resulting in damage to the underlying structure by limiting the extent that the tine can be inserted into the crevice. The gauge member is attached to the tine by placing each of two sections of the tine through apertures in the gauge member. The gauge member includes a plurality of apertures located at various distances from one end of the gauge member. The location of the gauge member on the tine depends on which apertures are used. The different placements of the gauge member on the tine allows the limit on the extent of insertion of the tine below the floorboards to be varied. The tine has a rectangular cross-section, a bevelled tip and a flat face which is perpendicular to the direction of cleaning when the tool is in use which provides improved clearing of the debris from the crevice. The elongated shaft allows the tool to be utilized in a standing position without bending over. The shaft is hollow and includes grips for convenient placement of the users hands during operation.

16 Claims, 3 Drawing Sheets

DECK CLEANING TOOL

FIELD OF THE INVENTION

This invention relates to a tool for removing debris from between adjacent floorboards of decks and similar structures.

BACKGROUND OF THE INVENTION

Outdoor decks usually have spaced floorboards laid parallel to one another upon a support structure. Debris, such as leaves, pine needles or the like, can collect on the deck surface and eventually become lodged in the spaces between the floorboards. This debris is unsightly and may decompose, causing damage to the surrounding floorboards and creating an unpleasant odour. Furthermore, the debris prevents complete coverage and penetration of stains that may be applied to the deck.

Common household tools, such as a broom, could be used for clearing loose debris from the surface of the deck. However, such tools are not suitable for efficiently cleaning debris that has become wedged within the spaces between the floorboards. Thin tools such as a knife or a screwdriver may be used to clean between the floorboards, but such tools may damage the underlying supporting structure of the deck. Furthermore, it is impractical to use such tools to clean an entire deck since one must bend down or kneel to work the tool along the spaces between the floorboards.

What is needed is a specialized tool for providing effective and efficient cleaning of the spaces between floorboards without causing damage to the underlying support structure of the deck.

SUMMARY OF THE INVENTION

In one aspect, the invention provides a tool for removing debris from a crevice, said tool comprising:

an elongated shaft;

a tine located at one end of said shaft for insertion into said crevice to engage said debris; and a gauge member located on said tine, said gauge member having a body defining a transverse edge for limiting the maximum depth of insertion of said tine into said crevice, said body including adjustment means for adjusting the position of said transverse edge relative to said tine to facilitate one of various maximum depths of insertion to be selected.

It will be recognized that a number of advantages are realized when using the tool according to the present invention. The gauge member prevents the tip of the tine from contacting (and thereby damaging) any support structure that may be located at the base of the crevice. Therefore, the user can apply sufficient force to adequately clean the crevice without concern of damage to the underlying support structure. The variability of the limiting means allows the tool to be utilized with crevices having different depths. The elongated shaft allows the user to stand while wielding the tool, resulting in a more comfortable and a quicker cleaning process. The simplified construction allows the device to be manufactured at a relatively low cost.

Further advantages of the present invention will become apparent upon review of the specification below.

BRIEF DESCRIPTION OF THE DRAWINGS

FIG. 4*b* is an enlarged view of the end of the gauge member illustrated in FIG. 4*a.

DETAILED DESCRIPTION OF THE PREFERRED EMBODIMENT

Figure 1:
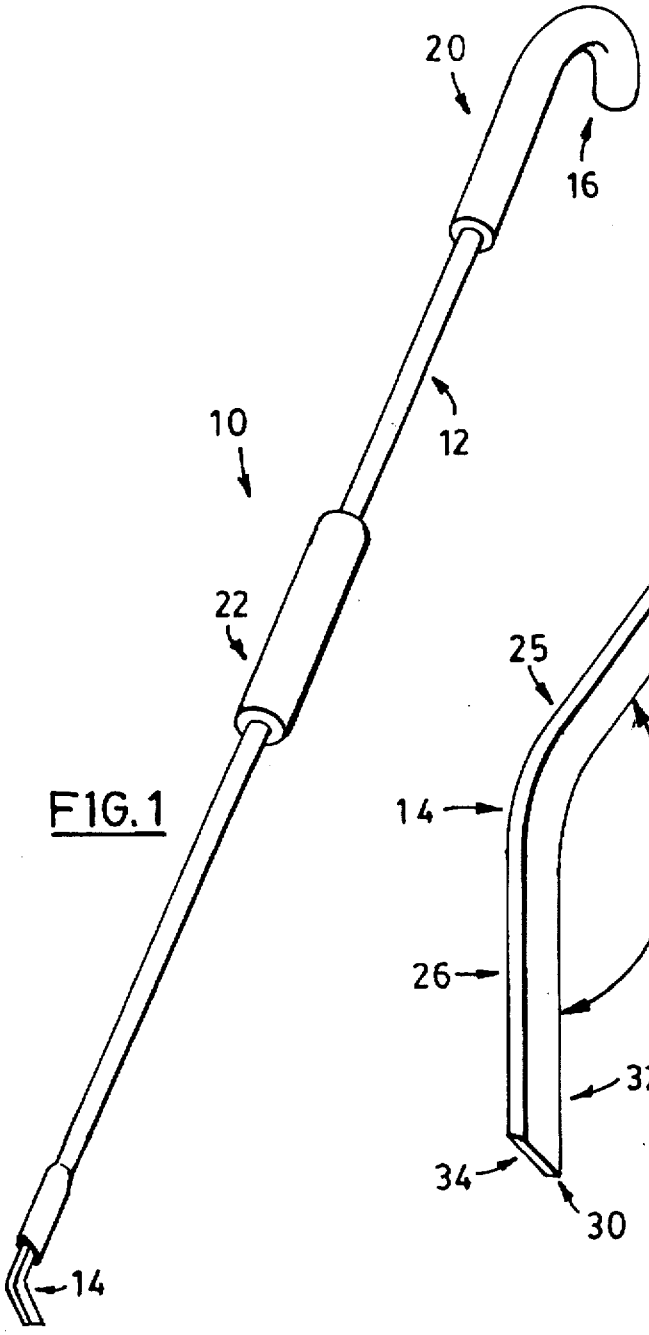
FIG. 1 is a perspective view of a tool in accordance with the present invention.
Figure 3:
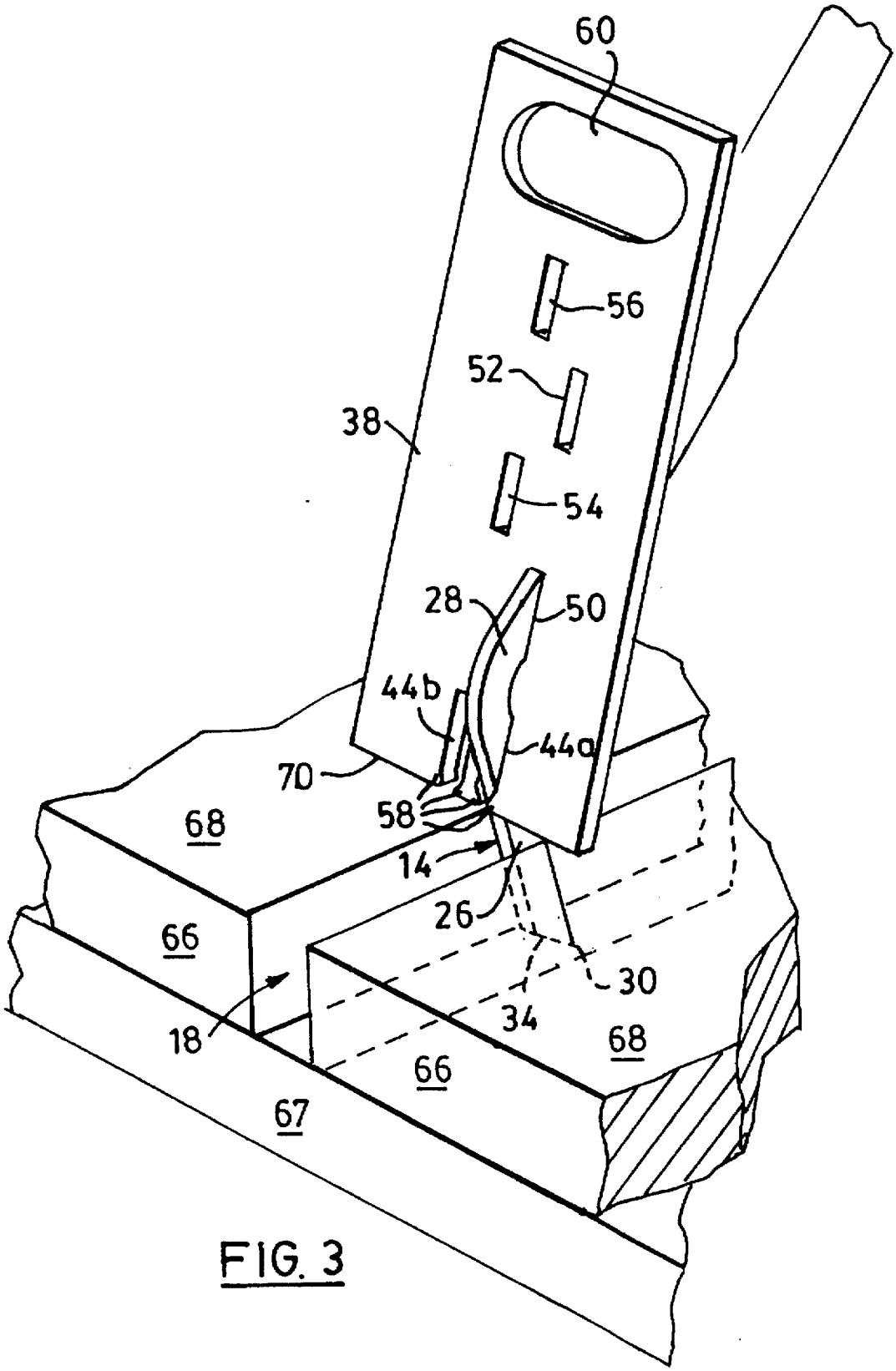
FIG. 3 is a perspective view of a gauge member located on the tine of FIG. 2, with the tine inserted into a crevice, in accordance with the present invention.

Referring now to FIG. 1, a tool in accordance with the present invention is generally shown at 10. The tool 10 includes an elongated shaft 12 with a line 14 at one end and a handle 16 at the other end. The time 14 is for insertion into a crevice 18 as shown in FIG. 3 and as described in more detail below.

The handle 16 is bent for convenient placement of the user's hand. A first grip 20 is included on the handle 16 and a second grip 22 is located on the shaft at some distance from the first grip 20. The operator wields the tool 10 with one hand on grip 20 and the other hand on grip 22. The grips 20 and 22 are made from polyethylene foam or another convenient gripping material to provide a comfortable grip during operation of the tool 10.

The shaft 12 is hollow and lightweight. The shaft 12 as shown is a ⅝" mild steel hollow tube. It will be understood, however, that any suitably sized shaft may be substituted and that the shaft may not necessarily be hollow if the material chosen is sufficiently lightweight. The shaft 12 is elongated to allow the operator to operate the tool 10 in a standing position. Since deck surfaces may be quite large, a standing position is preferable as the operator can clear a large surface without tiring or experiencing the discomfort that would occur when continuously kneeling or bending down to clear an entire deck. The operator can also obtain more leverage when using the tool 10 in a standing position which assists in clearing particularly clogged crevices and provides more effective and efficient cleaning.

Figure 2:
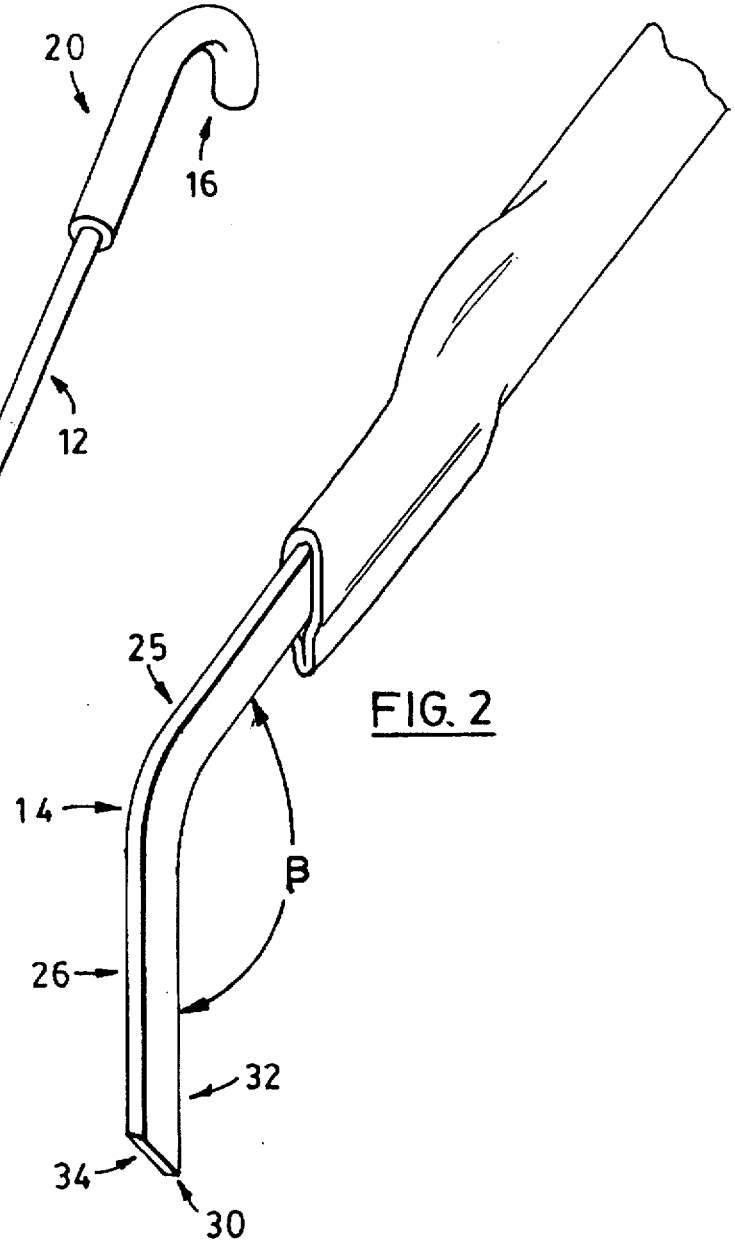
FIG. 2 is a perspective view of a tine of the tool of FIG. 1.

The tine 14 is shown in FIG. 2. The tine 14 is attached to the shaft 12 by means of a crimping tool which crimps the hollow end of the shaft 12 in a known manner to securely fasten the tine 14 to the shaft 12. It will be recognized, however, that other means of fastening the tine 14 to the shaft 12, such as bolting them together, will suffice and that it may be possible to construct the shaft 12 and the tine 14 as one continuous member. The tine 14 includes a first section 26 and a second section 28. The first section 26 and the second section 28 are oriented at an angle β relative to one another. It has been found that an angle β of 115° is suitable for this purpose and that an obtuse angle is preferred. However, other angles between the first section 26 and the second section 28 can be chosen and it will be recognized that the tine 14 need not be comprised of two straight portions oriented at an angle but could be formed in a continuous curve. The tine 14 is rectangular in cross-section and has a sufficient width to provide a flat engagement face 32. The width of the tine 14 is narrow enough to fit between two floorboards of a conventional deck while providing a sufficient area of the engagement face 32 to engage and guide debris from between two floorboards. It has been found that a tine width of ¼" is suitable for this purpose. The first section 26 of the tine 14 ends in a tip 30 which includes a bevelled face 34. The bevelled face 34 is opposite the flat engagement face 32. The bevelled face 34 meets the engagement face 32 at the tip 30 so that the tip 30 of the tine 14 is pointed to assist in breaking up debris that is wedged between the floorboards.

Figure 4A:
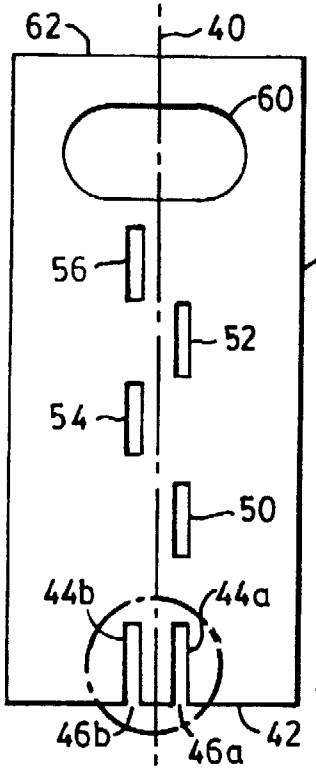
FIG. 4*a* is a plan view of the gauge member in accordance with the present invention.

Referring now to FIG. 4*a*, a gauge member 36 is shown. The gauge member 36 comprises a generally flat rectangular plate 38 having an imaginary centre line 40. The plate 38 includes an end 42. Two retaining apertures, 44*a* and 44*b*, are defined in the plate 38. The retaining apertures 44*a* and 44*b* are located at the end 42 of the plate 38 with the aperture 44*a* located on one side of the centre line 40 and the aperture 44*b* located on the other side of the centre line 40. The retaining apertures 44*a* and 44*b* are situated in the plate 38 with one end, 46*a* and 46*b*, respectively, located at the end 42 of the gauge member 36. Four locating apertures, 50, 52, 54, and 56 are also defined in the plate 38. Apertures 50 and 52 are aligned with the retaining aperture 44*a* along a line parallel to the centre line 40 of the plate 38. Apertures 54 and 56 are aligned with the retaining aperture 44*b* along a line parallel to the centre line 40 of the plate 38. Each locating aperture 50, 52, 54, 56 is situated at a unique distance from the end 42 of the plate 38 as follows:

| Aperture | Distance from end 42 to the centre of aperture |
|---|---|
| 50 | 1.421" |
| 52 | 2.810" |
| 54 | 2.189" |
| 56 | 3.404" |

It will be understood however, that other convenient locations of the apertures may be chosen and that the configuration of the gauge member 36 may be otherwise varied while still achieving the desired result. For example, for appropriately sized apertures, it would be possible to have just one retaining aperture aligned with a number of locating apertures or to have three or four retaining apertures, each aligned with one or more locating apertures. As well, the gauge member 36 could be of a shape other than rectangular, as long as a transverse edge exists to traverse the crevice. For example, the gauge member could be provided by a pair of arms extending obliquely from the tine with variability provided by different sized attachment members for releasable attachment to the arms.

All of the apertures 44*a*, 44*b*, 50, 52, 54, and 56 are for closely receiving the tine 14. As shown, each of the retaining apertures 44 and each of the locating apertures 50, 52, 54, and 56 are 0.574" long and 0.252" wide. These dimensions are designed to fit the dimensions of the cross-section of the time 14 with some tolerance. It will be understood that the tolerance may vary somewhat. However, a relatively close fit between the tine and the apertures is preferred to provide a stable attachment of the plate 38 to the tine 14 (the attachment of the plate 38 to the tine 14 is discussed further below).

Figure 4B:
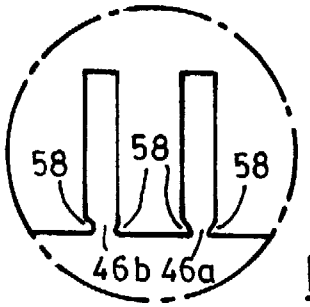

As illustrated in FIG. 4*b*, the ends 46 of the retaining apertures 44*a*, 44*b* not fully closed. Instead, the ends 46 are provided with retaining protrusions 58. The retaining protrusions 58 are adapted to allow the tine 14 to be snapped past the retaining protrusions 58 into the retaining apertures 44. Once the tine 14 has been snapped into a retaining aperture 44*a* or 44*b*, whichever is in use, the retaining protrusions 58 prevent the tine 14 from slipping out of the relevant retaining aperture 44*a* or 44*b*. The tine 14 can be removed from the relevant retaining aperture 44*a* or 44*b* by simply snapping the tine 14 out of the relevant retaining aperture 44*a* or 44*b* and past the retaining protrusions 58.

Returning now to FIG. 4*a*, a grasping hole 60 is defined in the plate 38. The plate 38 further includes an end 62 which is opposite to the end 42 of the plate 38. The hole 60 is located near the end 62. The hole 60 allows the user to grasp the plate 38 using two fingers. The operator of the tool 10 uses the hole 60 to place the plate 38 onto the tine 14 and remove the plate 38 from the tine 14.

The plate 38 is comprised of a readily available polymer, such as beutadiene-acrylonitrate or polypropylene, which provides sufficient rigidity to resist downwards force placed on the plate 38 when the tool is in use, but which is easily manufactured and allows the retaining apertures 44*a*, 44*b*, the locating apertures 50, 52, 54, 56 and the hole to be stamped out of suitably dimensioned plate material. However, it will be recognized that other plastics and offer materials, such as wood or metal, may be substituted.

Referring now to FIG. 3, the plate 38 is shown attached to the tine 14 using the locating aperture 50 and the retaining aperture 44*a* of the plate 38. This attachment of the plate 38 to the tine 14 can explained as follows. First, the operator inserts the tip 30 of the tine 14 through the locating aperture 50. Then, the operator slides the plate 38 over the first section 26 and onto the second section 28 of the tine 14 until the second section 28 of the tine 14 extends through the locating aperture 50. The operator then secures the plate 38 to the tine 14 by snapping the first section 26 of the tine 14 past retaining protrusions 58 into the retaining aperture 44*a*. The plate 38 may be similarly attached to the tine 14 using the offer locating apertures 52, 54 or 56 and their corresponding retaining aperture 44*a* or 44*b*. The locating apertures and the retaining apertures correspond as follows: if the locating apertures 50 or 52 are used, the first section 26 is snapped into the retaining aperture 44*a*; if the locating apertures 54 or 56 are used, the first section 26 is snapped into the retaining aperture 44*b*.

Referring further to FIG. 3, the crevice 18 is formed by two adjacent floorboards 66 supported on a beam 67. The floorboards 66 include upper surfaces 68. The tip 30 of the tine 14 is inserted into the crevice 18. A transverse edge 70 of the plate 38 is located at the end 42 of the plate 38. The transverse edge 70 of the plate 38 abuts against the upper surfaces 68 of the floorboards 66. The transverse edge 70 of the plate 38 is dimensioned so that the transverse edge 70 contacts each of the upper surfaces 68 of the floorboards 66 on either side of the crevice 18 to traverse the crevice 18. In this position, the plate 38 creates a maximum limit on the depth of insertion of the tip 30 of the tine 14 into the crevice 18 by preventing further displacement of the tip 30 into the crevice 18. It will be recognized that the desired maximum depth of insertion is one where the maximum depth of insertion is slightly less than the depth of the crevice 18. Thus, when the plate 38 is in place, the tip 30 cannot come into contact with the beam 67 at the base of the crevice 18 during operation of the tool 10 and the operator may apply sufficient pressure to the tool 10 to remove the debris from the crevice 18 without damaging the beam 67. The tip 30 still extends far enough into the crevice 18 to ensure that the crevice 18 is thoroughly cleaned.

In use, the flat engagement face 32 of the tine 14 is located transversely in the crevice 18. When utilizing the tool 10, most of the cleaning force is provided by pulling the tool 10 towards the user so that the flat engagement face 32 moves through the crevice 18 dislodging and removing debris wedged within the crevice 18. The engagement face 32 is preferably flat to insure more thorough removal of the debris from the crevice 18. The combination of the flat engagement face 32 and the bevelled face 34 of the tip 30 tends to lift the debris from the crevice 18, rather than pressing the debris downwards further into the crevice 18.

Figure 5:
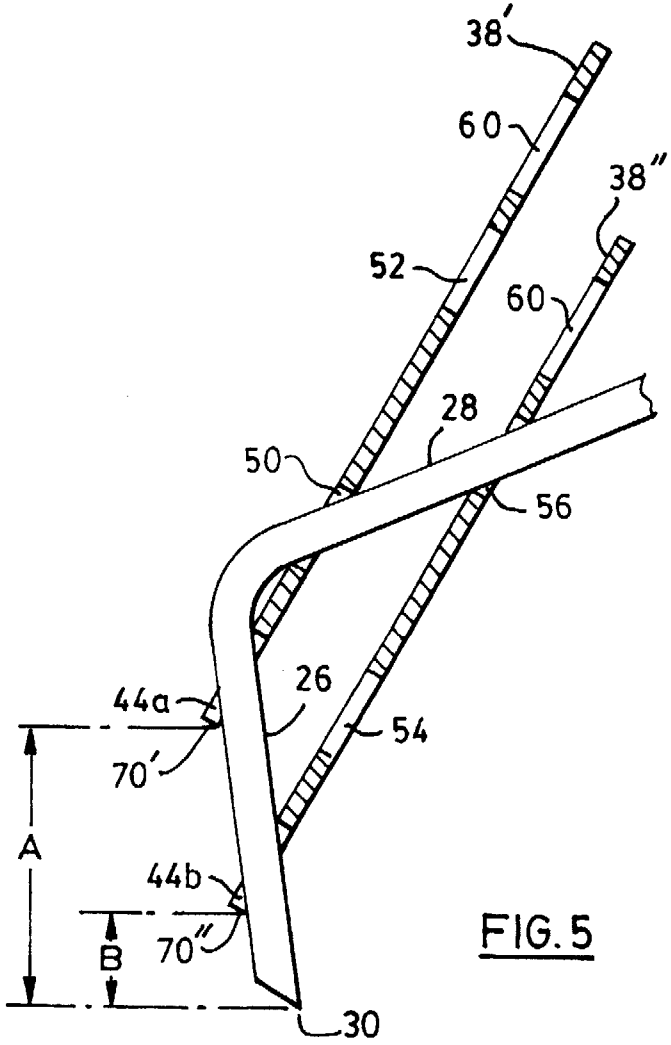
* and FIG. 5 is a side view of the tine of FIG. 2 with the gauge member shown in two different locations on the tine.

Referring now to FIG. 5, the variable limiting function of the gauge member 36 on the tine 14 may be more fully explained. Two plates 38' and 38" are shown attached to the tine 14 in two different locations. (Although FIG. 5 shows two plates 38' and 38", it will be recognized that this is merely for illustrative purposes and that only one plate 38 is required for use of the tool 10.) The plates 38' and 38" have transverse edges 70' and 70". The vertical distance from the transverse edge 70' of the plate 38' to the tip 30, is shown at A. In use, the transverse edge 70' abuts against the upper surfaces 68 of the floorboards 66, therefore A is the maximum depth of insertion of the tip 30 for the location of the plate 38'. The vertical distance from the transverse edge 70" of the gauge member 36" to the tip 30 is shown at B. Again, in use the transverse edge 70" of the plate 38" abut against the upper surfaces 68 of the floorboards 66 so that B would be the maximum depth of insertion of the tip 30 for the location of the plate 38". As is evident from FIG. 5, distance A is greater than distance B.

The location of the plate 38' is achieved by placing the tine 14 through the locating aperture 50 and the retaining aperture 44*a*. The location of the plate 38" is achieved by inserting the tine 14 through the locating aperture 56 and the retaining aperture 44*b*. As described above, the retaining apertures are both located at the end 42, while the locating aperture 56 is farther from the end 42 than the locating aperture 50. Therefore, the distance between the locating aperture 56 and its corresponding retaining aperture 44*b* is greater than the distance between the locating aperture 50 and the corresponding aperture 44*a*. It is the distance between the relevant locating aperture and its corresponding retaining aperture which governs the location of the plate 38 on the tine 14 and the resulting maximum depth of insertion for that location of the plate 38 on the tine 14. As discussed in respect of FIG. 4*a*, each locating aperture 50, 52, 54 and 56 is located at a unique distance from the end 42 and the retaining apertures 44. Thus the distance between each locating aperture 50, 52, 54 and 56 and its corresponding retaining aperture 44*a* or 44*b* is unique and results in a unique maximum depth of insertion as follows:

| Apertures | Maximum Depth of Insertion |
|---|---|
| 44b and 56 | ¾" |
| 44a and 54 | 1⅛" |
| 44b and 52 | 1½" |
| 44a and 50 | 2" |

Therefore, the variation in the maximum depth of insertion arises from the different locations of the locating apertures 50, 52, 54 and 56 in the plate 38.

The choice of which locating aperture 50, 52, 54 or 56 to use will depend upon the depth of the crevice which in turn relates to the thickness of the boards which form the crevice. The deeper the crevice the farther the tip can extend into the crevice without contacting the supporting structure and the greater the allowable maximum depth of insertion and vice versa for shallow crevices. To insure that the crevice is cleaned thoroughly, the operator will choose the aperture which allows the tip 30 to extend as far into the crevice as possible without contacting the underlying supporting structure.

While the above description constitutes the preferred embodiment, it will be appreciated that the present invention is susceptible to modification and change without departing from the fair meaning of the proper scope of the accompanying claims.

I claim:

1. A tool for removing debris from a crevice, said tool comprising:

an elongated shaft;

a tine located at one end of said shaft for insertion into said crevice to engage said debris; and a gauge member located on said tine, said gauge member having a body defining a transverse edge for limiting the maximum depth of insertion of said tine into said crevice, said body including adjustment means for adjusting the position of said transverse edge relative to said tine to facilitate one of various maximum depths of insertion to be selected.

2. The tool of claim 1 wherein said shaft is sized to facilitate withdrawal of said debris by an operator of said tool in a standing position.

3. The tool of claim 1 wherein said shaft is substantially hollow.

4. The tool of claim 1 further comprising grips located on said shaft.

5. The tool of claim 1, wherein said adjustment means comprises at least three apertures defined in said body, said tine extending through a pair of said apertures to mount said gauge member to said tool.

6. The tool of claim 5, wherein said apertures are defined at unique distances relative to said transverse edge on said gauge member.

7. The tool of claim 6, wherein said tine includes first and second portions that are oriented at an angle relative to each other, said first portion extending through a first one of said apertures and said second portion extending through a second one of said apertures to locate said gauge member on said tine at one of said various maximum depths of insertion.

8. The tool of claim 1, wherein said tine has a generally flat engagement face that is adapted to be disposed transversely in said crevice for engaging said debris.

9. The tool of claim 1 wherein said line is rectangular in cross-section.

10. The tool of claim 1 wherein said tine includes a pointed tip.

11. A gauge member mountable to a tool having a tine for removing debris from a crevice, said gauge member comprising:

a body defining a transverse edge for limiting the depth of insertion of said tine into said crevice; and adjustment means located on said body for adjusting the position of said transverse edge relative to said tine to facilitate one of various maximum depths of insertion to be selected.

12. A gauge member as claimed in claim 11, wherein said body is generally planar.

13. A gauge member as claimed in claim 11, wherein said adjustment means comprises at least three apertures defined in said body, said tine extending through a pair of said apertures to mount said gauge member to said tool.

14. A gauge member as claimed in claim 13, wherein said apertures include a retaining aperture that is defined generally normally to said transverse edge.

15. A gauge member as claimed in claim 14, wherein a pair of opposing protrusions extend inwardly into said retaining aperture proximate to said transverse edge for releasably engaging said tine.

16. A gauge member as claimed in claim 15, wherein said apertures further include a plurality of locating apertures located at unique distances from said transverse edge in line with said retaining aperture, said tine extending through said retaining aperture and one of said locating apertures.

* * * * *